US006301846B1

(12) United States Patent
Waalkes et al.

(10) Patent No.: US 6,301,846 B1
(45) **Date of Patent: *Oct. 16, 2001**

(54) KNOCK-DOWN PORTABLE PARTITION SYSTEM

(75) Inventors: Michael L. Waalkes, Grand Rapids, MI (US); Marcus K. Pressnell, Athens, AL (US); Mark T. Slager, Caledonia, MI (US); Michael R. Shields, Greensboro, NC (US); Brian J. Kane, San Francisco, CA (US); Robin Christopher, Athens, AL (US); Dennis J. Boyle, Palo Alto, CA (US); Peter N. Skillman, San Carlos, CA (US); Charles A. Seiber, Atherton, CA (US); Joseph Chang, Grand Rapids, MI (US)

(73) Assignee: Steelcase Development Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/407,520

(22) Filed: Sep. 28, 1999

Related U.S. Application Data

(63) Continuation-in-part of application No. 08/914,664, filed on Aug. 19, 1997, now Pat. No. 6,009,675, which is a continuation-in-part of application No. 09/243,915, filed on Feb. 3, 1999, now Pat. No. 6,079,173, which is a continuation of application No. 08/856,995, filed on May 15, 1997, now Pat. No. 5,899,035.

(60) Provisional application No. 60/033,884, filed on Dec. 24, 1996.

(51) Int. Cl.[7] ..... E04H 14/00

(52) U.S. Cl. ..... 52/239; 52/220.7

(58) Field of Search ..... 52/220.7, 239

(56) References Cited

U.S. PATENT DOCUMENTS

D. 127,967 7/1941 Meyer .
D. 407,665 4/1999 Churchville .
2,430,654 11/1947 Voege .

(List continued on next page.)

FOREIGN PATENT DOCUMENTS

3726255A1 1/1989 (DE) .
50241 4/1982 (EP) .
200514A1 11/1996 (EP) .

*Primary Examiner*—Carl D. Friedman
*Assistant Examiner*—Kevin McDermott
(74) *Attorney, Agent, or Firm*—Price, Heneveld, Cooper, DeWitt & Litton

(57) ABSTRACT

A knock-down portable partition includes a rigid panel frame having a central portion. The partition includes at least one cover panel covering at least a portion of the central portion of the rigid panel frame. Connectors detachably mount the cover panel on the panel frame to facilitate assembly and removal of the cover panel on the panel frame. The rigid panel frame includes at least two vertical posts having an upper end, a lower end, and opposite side faces. The opposite faces have at least two beam connection ports thereon positioned adjacent the upper and lower ends of the associated one of the posts. The panel frame also includes upper and lower beams extending generally horizontally between the vertical posts adjacent the upper and lower ends thereof, and interconnecting the vertical posts adjacent the connection ports. The panel frame includes quick-disconnect connectors such as movable lock members positioned on one of the posts and the beams adjacent the connection ports. The movable lock members are movably mounted for shifting between an unlocked position and a locked position. The panel frame further includes lock engaging surfaces positioned on the other of the posts and the beams adjacent the connection ports. The lock engaging surfaces are located thereon and abuttingly engage the lock members when the lock members are shifted to the locked position to rigidly yet detachably interconnect the posts and the beams for quick and complete assembly and disassembly of the knockdown portable partition.

27 Claims, 15 Drawing Sheets

U.S. PATENT DOCUMENTS

| | | | | |
|---|---|---|---|---|
| 3,638,376 | | 2/1972 | Howes et al. . | |
| 3,713,474 | | 1/1973 | Orlando . | |
| 3,789,567 | | 2/1974 | Rae et al. . | |
| 3,886,698 | | 6/1975 | Raith et al. . | |
| 3,971,182 | | 7/1976 | Donahue et al. . | |
| 4,018,019 | | 4/1977 | Raith et al. . | |
| 4,048,768 | | 9/1977 | Good . | |
| 4,123,879 | | 11/1978 | Blodee et al. . | |
| 4,314,429 | | 2/1982 | Casteel et al. . | |
| 4,338,990 | | 7/1982 | Blodee et al. . | |
| 4,356,672 | | 11/1982 | Beckman et al. . | |
| 4,416,093 | | 11/1983 | Salkeld et al. . | |
| 4,434,596 | | 3/1984 | McAteer et al. . | |
| 4,448,231 | | 5/1984 | Salkeld et al. . | |
| 4,625,476 | | 12/1986 | Shimada . | |
| 4,682,457 | | 7/1987 | Spencer . | |
| 4,761,922 | | 8/1988 | Black . | |
| 4,837,988 | | 6/1989 | Menchetti et al. . | |
| 5,033,526 | | 7/1991 | DeLong et al. . | |
| 5,214,890 | | 6/1993 | Levitan et al. . | |
| 5,219,406 | | 6/1993 | Raz . | |
| 5,241,796 | | 9/1993 | Hellwig et al. . | |
| 5,487,246 | * | 1/1996 | Hodges | 52/220.7 |
| 5,495,952 | | 3/1996 | Kainz . | |
| 5,511,349 | | 4/1996 | Kelley et al. . | |
| 5,555,689 | | 9/1996 | Gilmore . | |
| 5,600,926 | | 2/1997 | Ehrlich . | |
| 5,606,919 | | 3/1997 | Fox et al. . | |
| 5,642,593 | | 7/1997 | Shieh . | |
| 5,657,606 | | 8/1997 | Ressel et al. . | |
| 5,657,885 | | 8/1997 | White et al. . | |
| 5,899,035 | | 5/1999 | Waalkes et al. . | |
| 5,931,429 | | 8/1999 | Hellwig et al. . | |
| 6,009,675 | * | 1/2000 | Waalkes | 52/239 |
| 6,079,173 | * | 6/2000 | Waalkes | 52/239 |

* cited by examiner

KNOCK-DOWN PORTABLE PARTITION SYSTEM

This application is a Continuation-In-Part of application Ser. No. 08/914,664, filed Aug. 19, 1997, now issued U.S. Pat. No. 6,009,675, which claims the benefit of U.S. Provisional Application No. 60/033,884, filed Dec. 24, 1996, the entire contents of each of which is hereby incorporated herein by reference.

This application is also a Continuation-In-Part of application Ser. No. 09/243,915, filed Feb. 3, 1999, now issued U.S. Pat. No. 6,079,173, which is a continuation of application Ser. No. 08/856,995, filed May 15, 1997, now issued U.S. Pat. No. 5,899,035, the entire contents of each of which is hereby incorporated by reference.

BACKGROUND OF THE INVENTION

The present invention relates to office partition panel systems, and in particular to a knock-down portable partition that has a unique post and beam construction configured for quick and easy on-site manual assembly.

The efficient use of building floor space is an ever growing concern, particularly as building costs continue to escalate. Open office plans have been developed to reduce overall officing costs, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable or portable partition panels that are detachably interconnected to partition off the open spaces into individual workstations and/or offices. Such partition panels have sufficient structural strength to receive hang-on furniture units, such as work surfaces, overhead cabinets, shelves, etc., and are generally known in the office furniture industry as "systems furniture." In addition, such partition panels have an acoustical, sound-absorbing configuration to promote a quiet, pleasant work environment.

Numerous partition panel systems have been developed for dividing office workspaces into smaller areas. Partition panel systems, like those disclosed in U.S. Pat. No. 4,996,811, utilize prefabricated rectangular partition panel members that have a unitary rigid perimeter frame formed by top, bottom, and end channels that are welded to one another. Decorative cover panels are fastened to opposite sides of the perimeter frame. Each perimeter frame member has a rectangular shape, and is fabricated and shipped as a single unit, often with the decorative cover panels pre-fastened to the frame. During installation, the prefabricated perimeter frame of each panel member is fastened to the perimeter frame of an adjacent panel member along the vertical edges thereof, either directly, or by a separate fastener post. Each partition panel member includes two height adjustable feet or glides along the bottom edge of each panel member, with one glide being located adjacent each vertical panel edge. Since there are two vertical frame members at each panel joint, this type of panel construction results in structural redundancy. In addition, since each glide must be properly adjusted for height, this configuration requires adjustment of both glides at each panel joint during assembly. Furthermore, although longer panels typically have a lower cost per unit length, longer panels are difficult to handle, which places a practical limit on the size of the partition panel member that can be shipped and installed as a prefabricated unit.

Other partition panel systems, like that disclosed in U.S. Pat. No. 5,150,554, utilize prefabricated rectangular partition panel members having a unitary perimeter frame that attaches to a post member along each vertical panel edge. Although this type of design may have a single glide at each post, each panel-to-post connection has at least two vertical structural members. Since only a single vertical member is needed to provide support and height adjustment, this type of system has redundant structure. In addition, the rectangular partition panel members are manufactured and shipped as a unit, limiting the size of the partition panel members that can be used.

Other office divider systems, like that disclosed in U.S. Pat. No. 5,406,760, utilize vertical posts and horizontal beams wherein each post attaches to an adjacent post along adjacent vertical edges. Since each post is attached directly to an adjacent post, this configuration also has redundant vertical structural members and glides.

Other office panel dividers, like that disclosed in U.S. Pat. Nos. 5,287,666 and 5,219,406, have multiple posts and beams with connector members that hold a pair of beams to adjacent posts. This configuration has two horizontal beams in a side-by-side relationship at each height location, and also has two vertical posts attached directly together in either a back-to-back or side-by-side relationship. Thus, there is redundancy in both the post and the beam structures. In addition, connector pieces are required to attach the beams to the posts.

SUMMARY OF THE INVENTION

One aspect of the present invention is a knock-down portable partition comprising a rigid panel frame having a central portion. The partition includes at least one cover panel covering at least a portion of the central portion of the panel frame. Connectors detachably mount the cover panel on the rigid panel frame to facilitate assembly and removal of the cover panel on the panel frame. The rigid panel frame includes at least two vertical posts having an upper end, a lower end, and opposite side faces. The opposite faces have at least two beam connection ports thereon positioned adjacent the upper and lower ends of the associated one of the posts. The panel frame also includes upper and lower beams extending generally horizontally between the vertical posts adjacent the upper and lower ends thereof. The upper and lower beams interconnect the vertical posts adjacent the connection ports. The panel frame has movable lock members positioned on one of the posts and the beams adjacent the connection ports. The movable lock members are movably mounted for shifting between an unlocked position and a locked position. The panel frame further includes lock engaging surfaces positioned on the other of the posts and the beams adjacent the connection ports. The lock engaging members abuttingly engage the lock engaging surfaces as the lock members are shifted to the locked position and rigidly yet detachably interconnect the posts and the beams for quick and complete assembly and disassembly of the knock-down portable partition.

Another aspect of the present invention is in a portable partition system, the improvement of a rigid knock-down frame construction including at least two vertical posts each having an upper end, a lower end, and opposite faces with at least two beam connection ports thereon positioned adjacent the upper and lower ends of the associated one of the posts. The frame construction includes upper and lower beams extending generally horizontally between the vertical posts adjacent the upper and lower ends thereof, and rigidly interconnecting the posts adjacent the connection ports. The frame construction also includes movable lock members positioned on one of the posts and the beams adjacent the connection ports, and being movably mounted thereon for shifting between an unlocked position and a locked position. The frame construction further includes lock engaging surfaces positioned on the other of the posts and the beams adjacent the connection ports. The lock members engage the lock engaging surfaces as the lock members are shifted to the locked position to rigidly yet detachably interconnect the posts and the beams for quick and complete assembly and disassembly of the knock-down portable partition.

Yet another aspect of the present invention is in a portable partition system, the improvement of a quick-disconnect frame connection system, including at least one post and at least one beam. At least one connection port is positioned between the post and the beam, and at least one movable lock member is positioned on one of the post and the beam adjacent to the connection port. A lock member is movably mounted thereon for shifting between an unlocked position and a locked position. At least one lock engaging surface is positioned on the other of the post and the beam adjacent to the connection port, and is abuttingly engaged by the lock member as the lock member is shifted to the locked position, creating a tight fit and rigidly yet detachably interconnecting the post and the beam.

The principal objects of the present invention are to provide a knock-down, portable partition system. Accordingly, the present partition provides a versatile, easily assembled and disassembled partition having reduced complexity and fewer components. The individual components are assembled at the installation site, thereby reducing shipping costs, and allowing for longer, more economical panel sizes. The partition panel is easily and quickly assembled, and does not require separate fasteners, such as conventional nuts and bolts. The partition panels have sufficient structural strength to support hang-on accessory units, such as binder bins, shelves, and work surfaces. Utility troughs may be installed at various heights between the posts to provide for electrical and communications conduits. The utility troughs may be installed or removed after the structural beams are installed between adjacent posts. Each post has a single adjustable foot, and a vertical row of slots for support of hang-on accessory units. Cover panels are installed to close off the open interior of the panel. Two adjacent cover panels are attached to a single post at each in-line panel joint.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
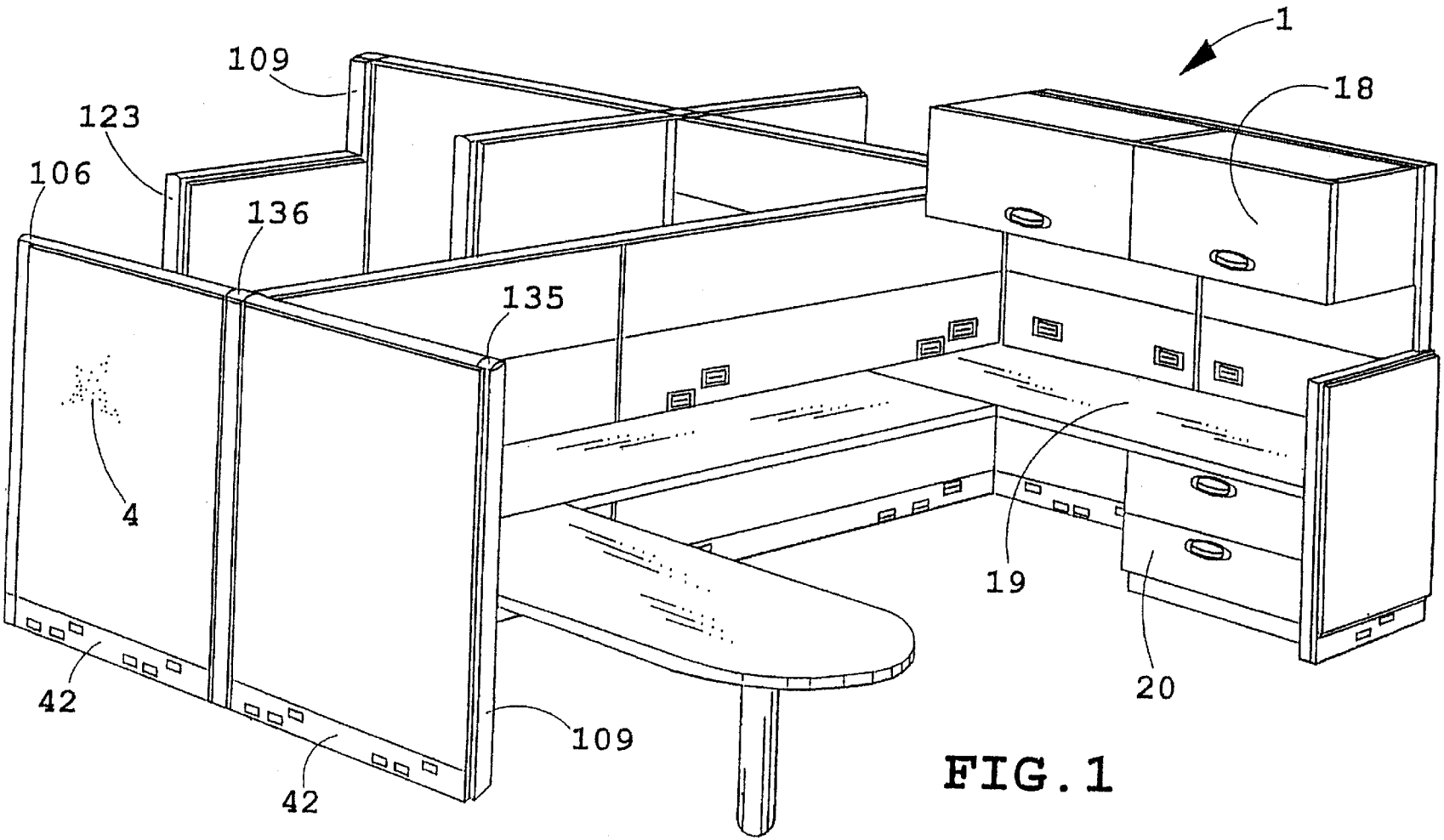
FIG. 1 is a perspective view of a knock-down partition system embodying the present invention comprising a post and beam construction which is covered by acoustic, decorative cover panels.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defied in the appended claims. Hence, specific dimensions and other physical characteristics relating to the embodiments disclosed herein are not to be considered as limiting, unless the claims expressly state otherwise.

The reference numeral 1 (FIG. 1) generally designates a knock-down portable partition system embodying the present invention. The illustrated knock-down portable partition system 1 has a panel frame 2 (FIGS. 2, 3) having a central portion 3 generally indicated by the reference numeral 3 in FIG. 3. At least one cover panel 4 covers at least a portion of the central portion 3 of the panel frame 2. Connectors 5 detachably mount the cover panel 4 on the panel frame 2 to facilitate assembly and removal of the cover panel 4 on the panel frame 2. The panel frame 2 includes at least two vertical junctions such as vertical posts 6 each having an upper end 7, a lower end 8, and opposite faces 9 with at least two beam connection ports 10 thereon positioned adjacent the upper and lower ends 7, 8 of the associated one of the posts 6. Upper and lower bars or beams 11 extend generally horizontally between the vertical posts 6 adjacent the upper and lower ends 7, 8 thereof, and interconnect the same adjacent the connection ports 10. Movable lock wedges 12 are positioned on one of the posts 6 and the beams 11 adjacent the connection ports 10, and are movably mounted thereon for shifting between a retracted unlocked position 13 and an extended locked position 14. As best seen in FIGS. 4 and 5, wedge-engaging surfaces 15 are positioned on the other of the posts 6 and the beams 11 adjacent the connection ports 10, and are located thereon to engage the wedges 12 in a tight interference fit when the wedges 12 are shifted to the extended locked position to rigidly yet detachably interconnect the posts 6 and the beams 11 for quick and complete assembly and disassembly of the knock-down portable partition 1.

Figure 4:
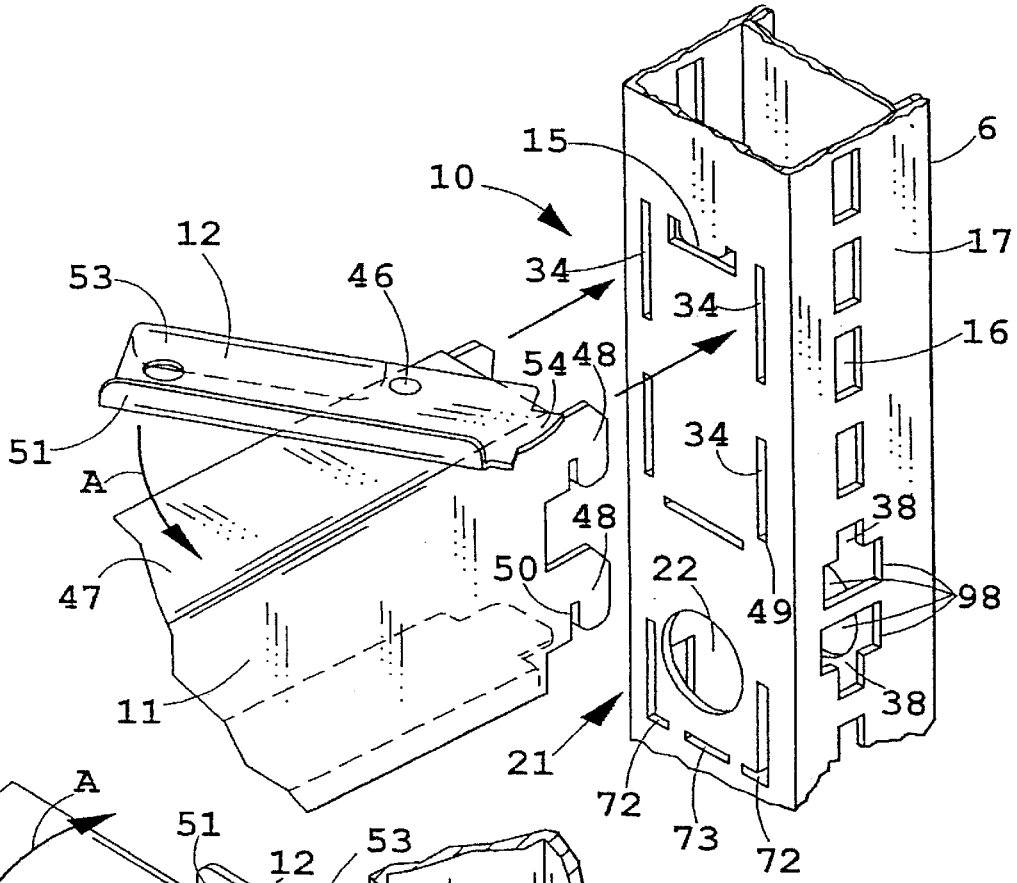
FIG. 4 is a fragmentary, perspective view of the wedge lock and beam connection port.
Figure 5:
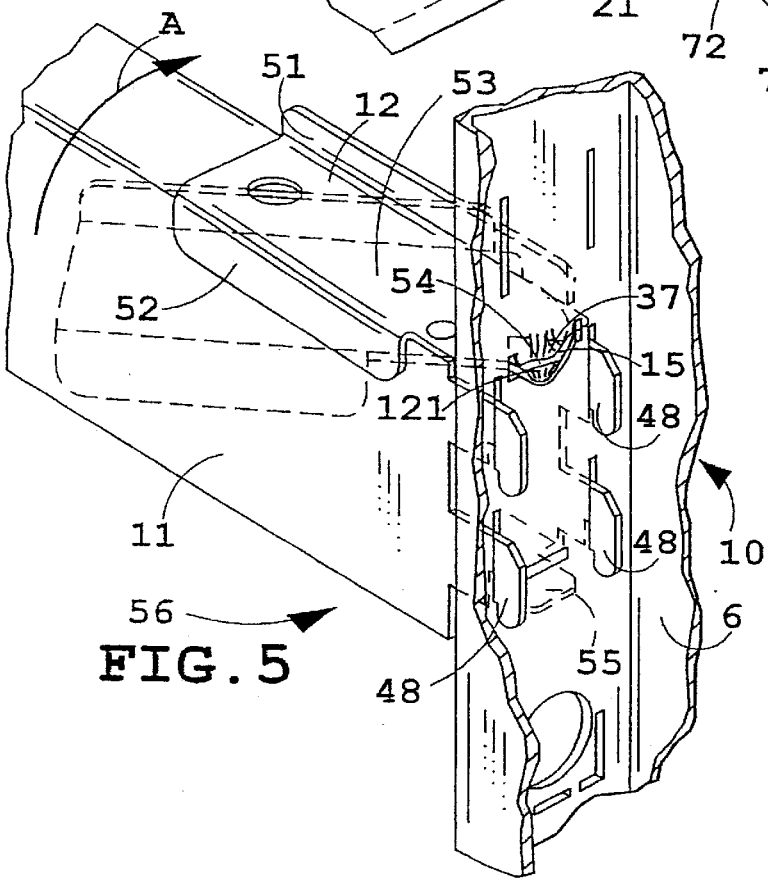
FIG. 5 is a fragmentary, perspective view of the lock wedge in the engaged position showing the inelastic deformation of the wedge-engaging surface.
Figure 6:
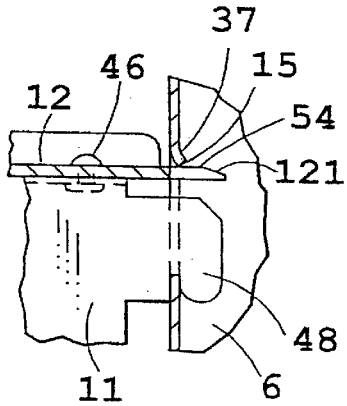
FIG. 6 is a fragmentary, front elevational view of the lock wedge in the engaged position sowing the deformation of the wedge-engaging surface.
Figure 7:
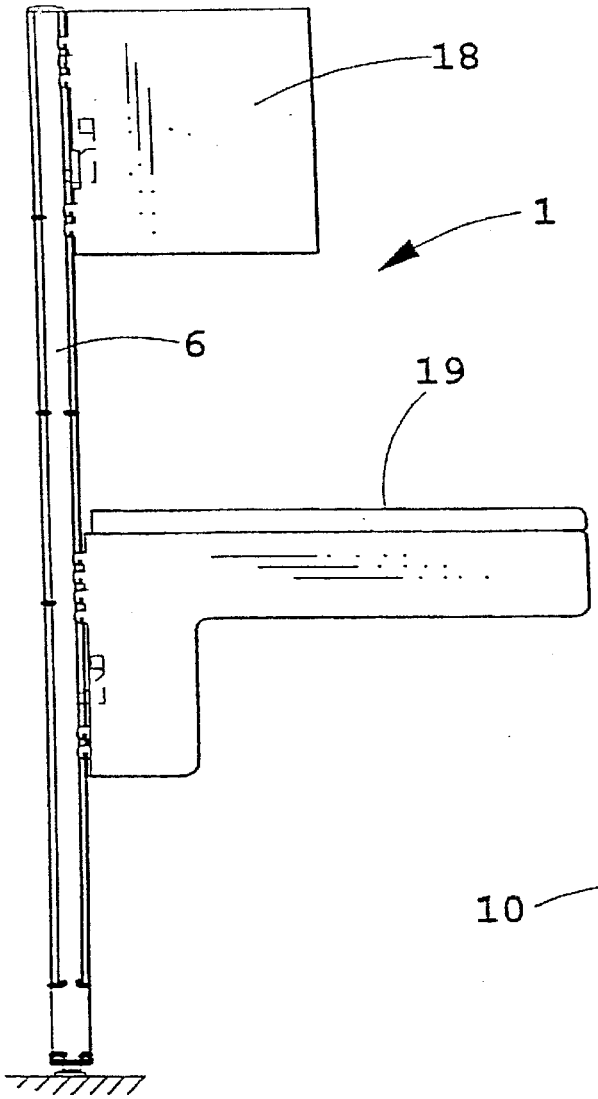
FIG. 7 is a partially schematic side elevational view of the partition system with hang-on bins and work surfaces installed.

In the illustrated example, the movable lock wedges 12 of the present invention form a quick-disconnect connector that engages and inelastically deforms the wedge-engaging surface 15 when the wedge 12 is shifted to the extended locked position 14 to create a tight interference fit which rigidly yet detachably interconnects the post 6 and the beam 11 (FIG. 5). In addition, each post 6 includes a vertical row of slots 16 extending along a vertical face 17. With reference to FIGS. 4 and 6, the vertical row of slots 16 provide for removably attaching a hang-on accessory unit such as a binder bin 18 or a work surface 19 (FIG. 7). A lower file storage unit 20 is also removably supported by the vertical row of slots 16 in the posts 6 (FIG. 1). Accordingly, the posts 6 each have sufficient structural strength to support the hang-on accessory units.

Figure 2:
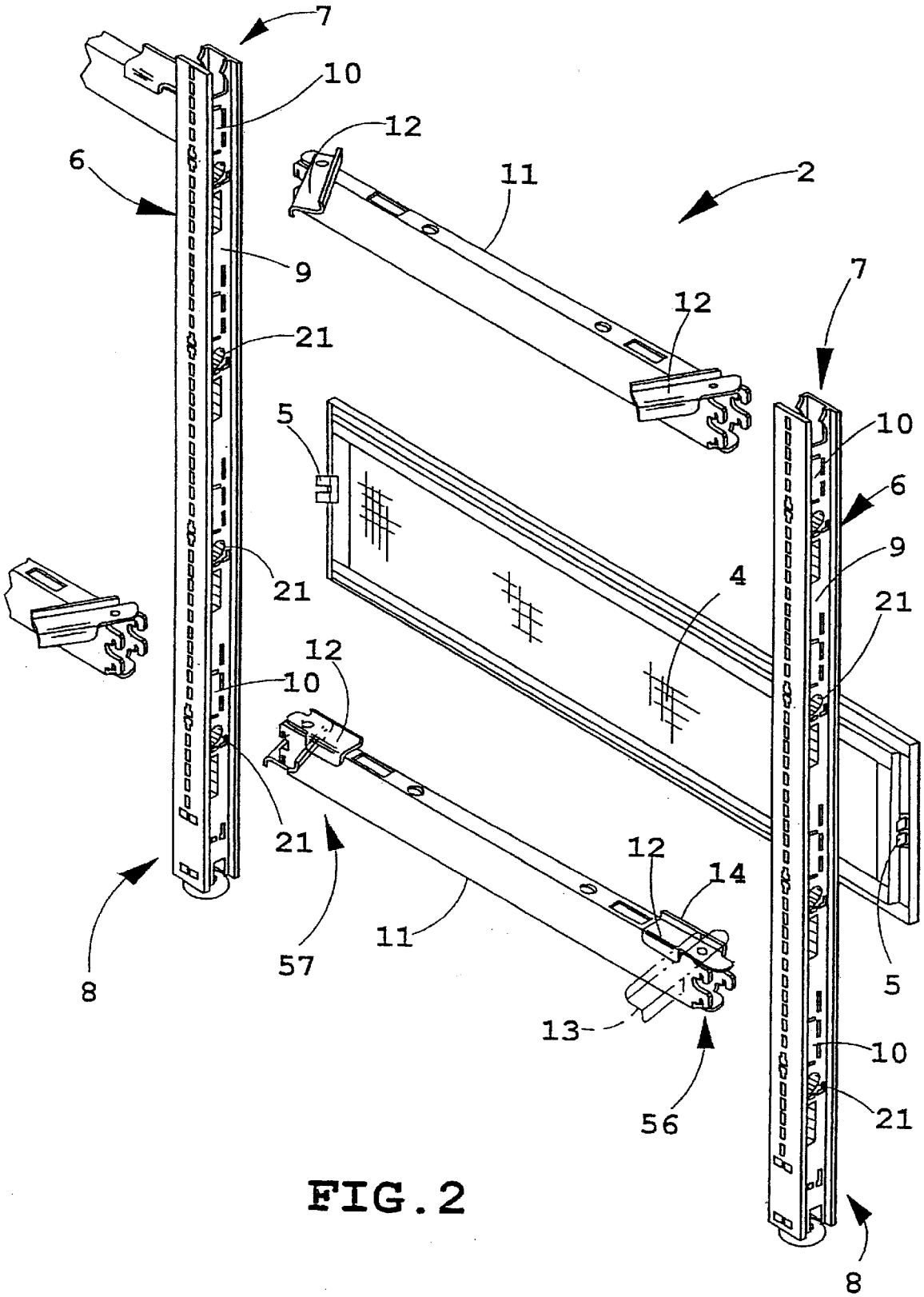
FIG. 2 is a fragmentary, exploded perspective view of the vertical posts, beams, and cover panels.
Figure 3:
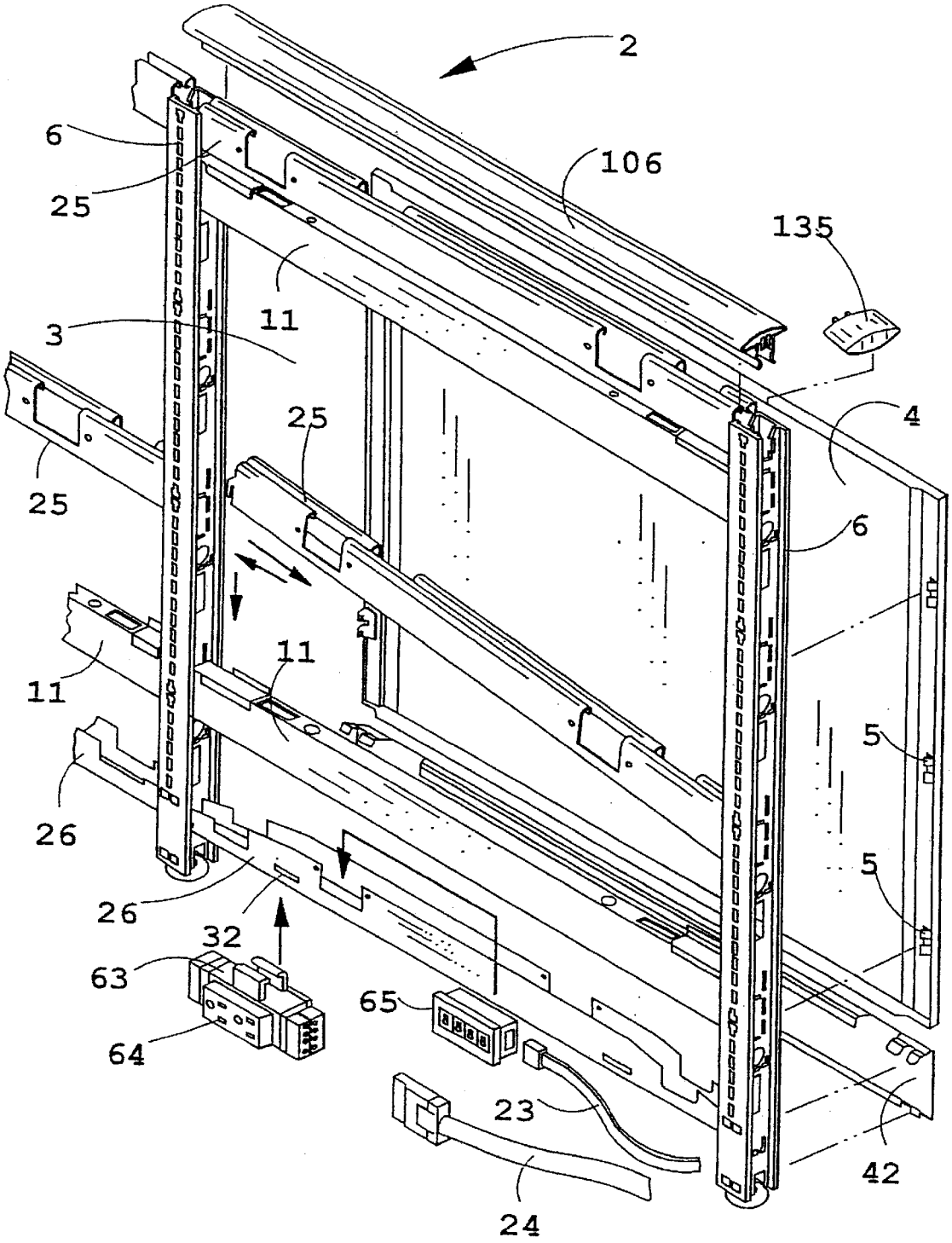
FIG. 3 is a fragmentary, exploded perspective view of the vertical posts, data and power troughs, beams and cover panels.

With reference to FIGS. 2–4, each of the vertical posts 6 include a plurality of utility trough ports 21 with associated windows 22 (FIG. 8) through the posts 6 for passing utility conduits such as data or communications lines 23 or power lines 24 therethrough (FIG. 3). The partition includes at least one utility trough such as data trough 25 or power trough 26 that are shaped to receive and retain utility conduits therein. The utility troughs have opposite ends thereof configured to be detachably connected with a horizontally aligned pair of utility trough ports 21 on the posts 6 when the panel frame 2 is in an assembled condition.

Figure 9:
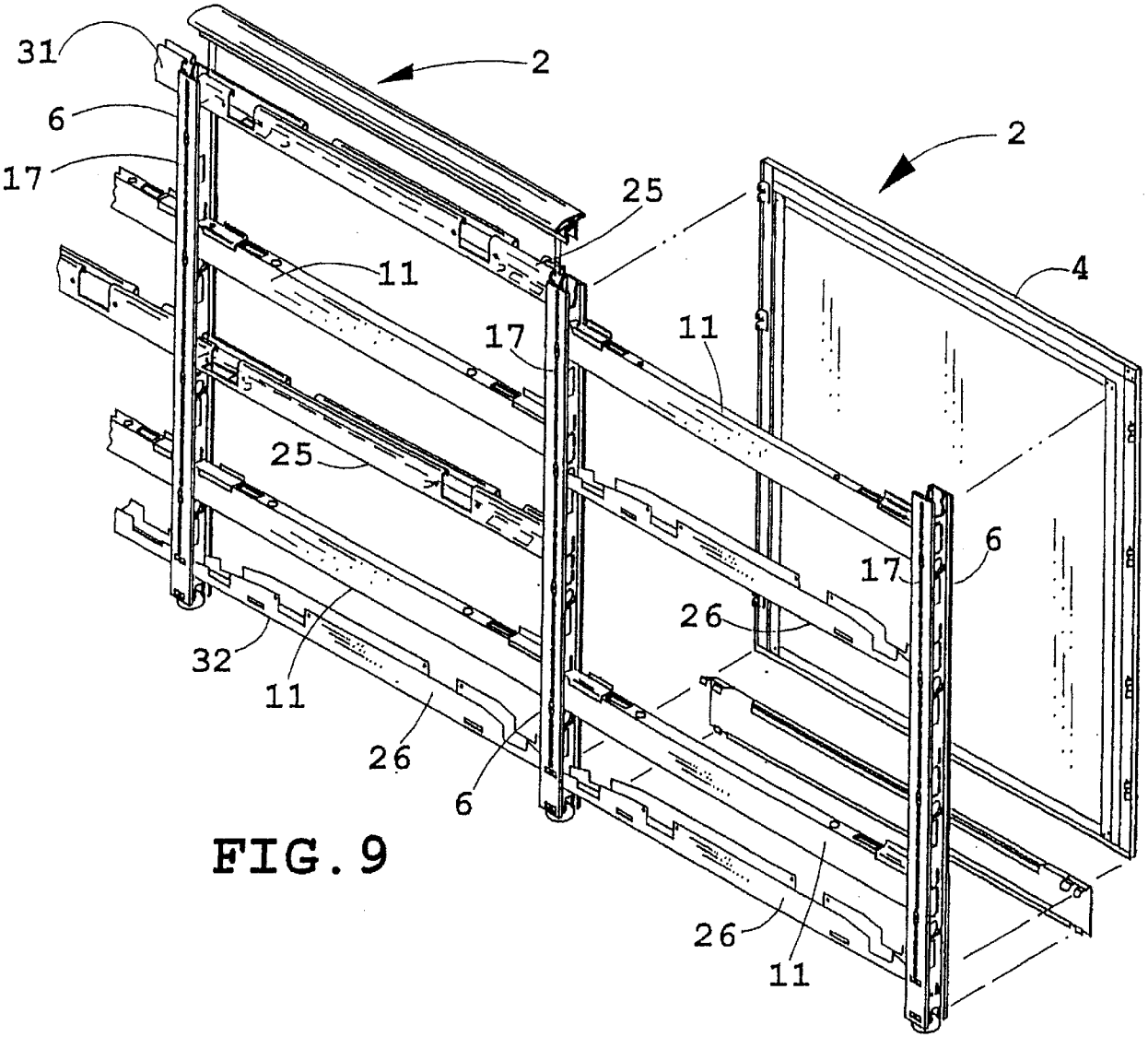
FIG. 9 is a fragmentary, perspective view of two adjacent panel frames showing an intermediate post with beams rigidly connected to both opposite side faces.
Figure 12:
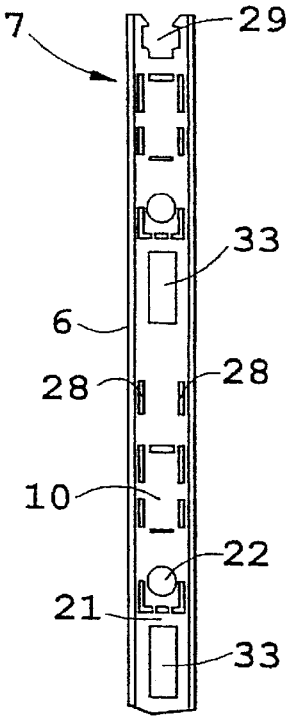
FIG. 12 is a top plan view of the vertical post.
Figure 12:
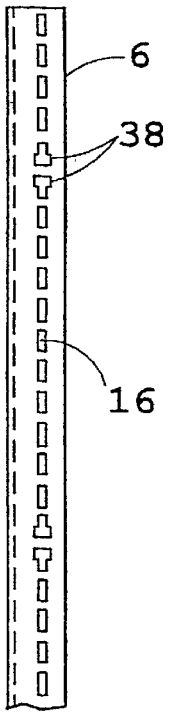
Figure 12:
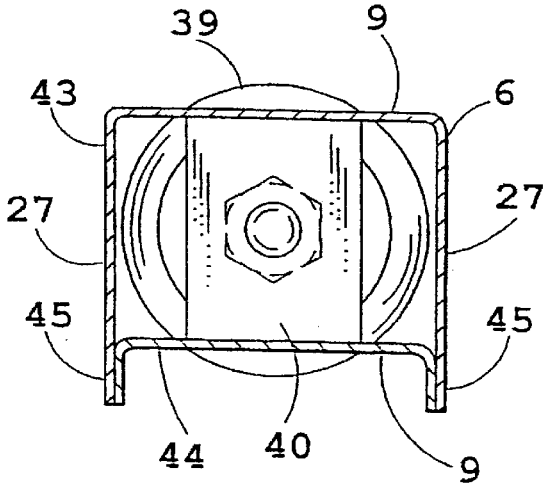
Figure 10:
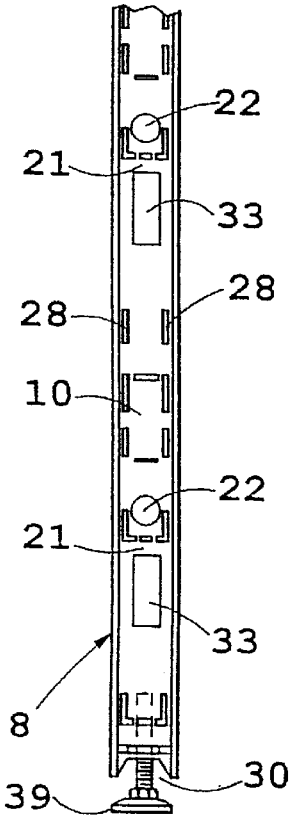
FIG. 10 is fragmentary, front elevational view of the vertical post.
Figure 11:
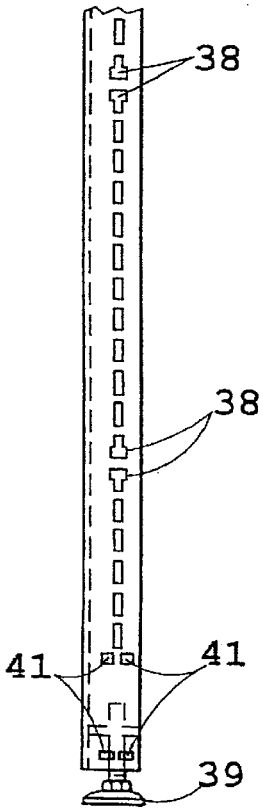
FIG. 11 is a fragmentary, side elevational view of the vertical post.
Figure 13:
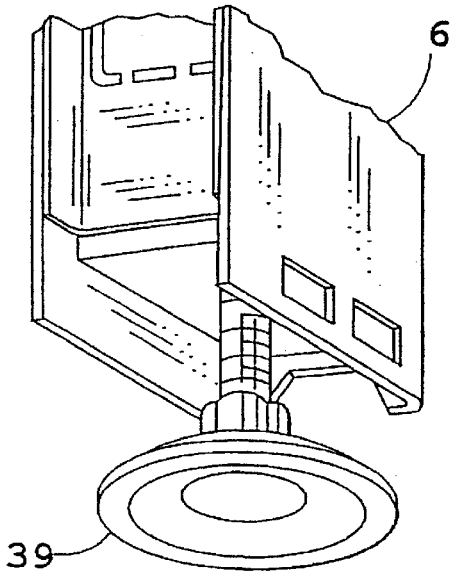
FIG. 13 is a fragmentary, perspective view of the bottom end of the vertical post showing the foot.

As best seen in FIG. 9, two adjacent rigid panel frames 2 are formed by three vertical posts 6 and at least four beams 11 extending generally horizontally between the posts 6 adjacent the upper and lower ends 7, 8 thereof. The beams 11 provide the primary structural interconnection between the posts 6, with the cover panels 4 providing acoustical and decorative functions.

Figure 8:
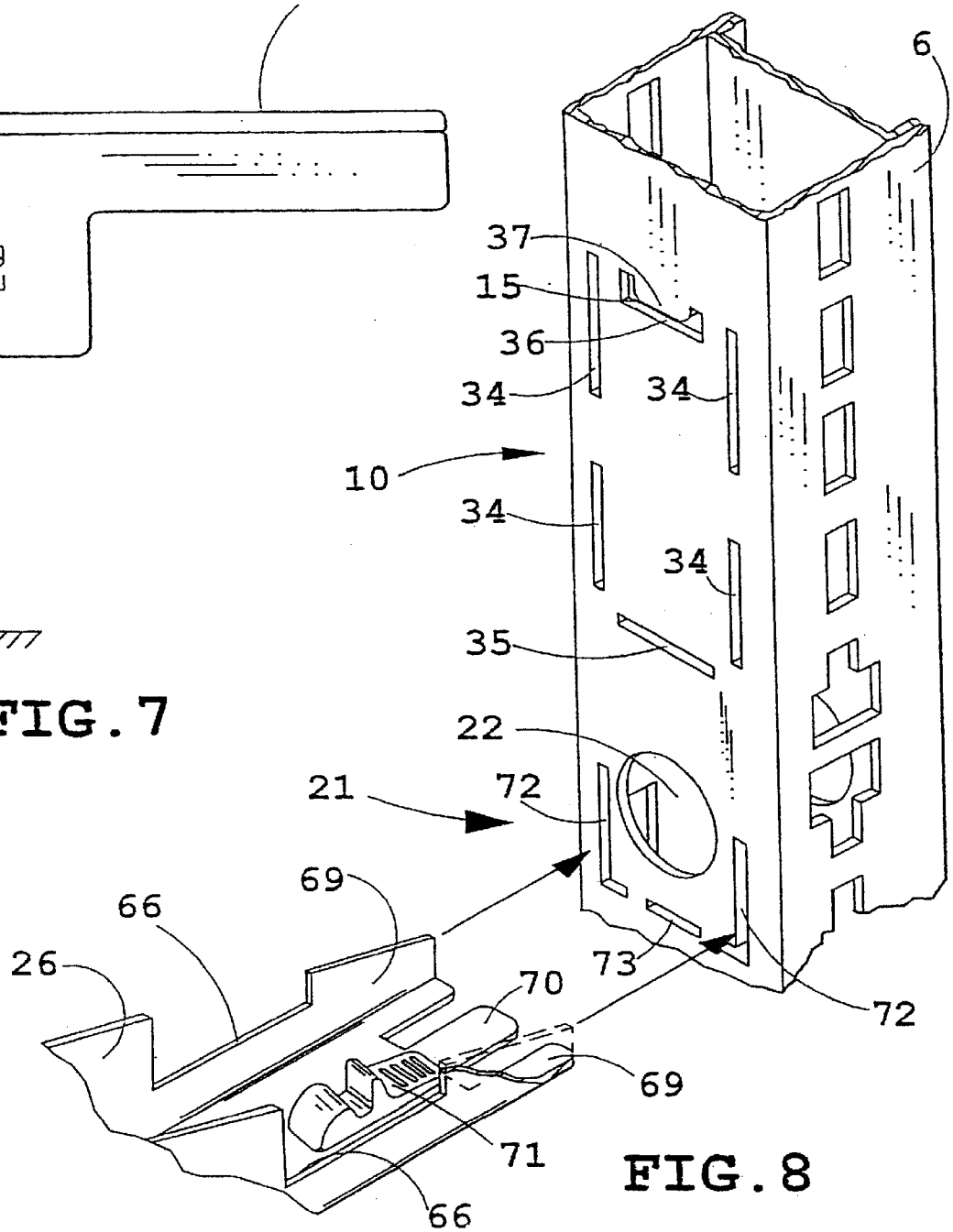
FIG. 8 is a fragmentary, perspective view of the utility trough port and a power trough with sliding wedge.

As shown in FIGS. 10–13, each vertical post 6 has a pair of opposite faces 9 and front faces 27. Each post 6 includes an upper utility trough port 29 having a window that is open along the upper side for lay-in of utility conduits such as data lines 23 along the top edge 31 (See FIG. 33) of the panel frame 2. In addition, each post 6 has a utility trough port 21 adjacent the lower end, with a window 30 (FIG. 10) having an open lower edge for lay-in of utility conduits such as power lines 24 along the bottom edge 32 of the panel frame 2 (FIG. 3). Each of the utility trough ports 21 include a circular window 22 and a rectangular window 33. Data and power lines 23, 24 that are routed in the data or power troughs 25, 26 may be fed through the windows 22. If required, power box 63 may be snapped to the bottom of the power trough 26 (FIG. 3), and the power line 24 passed through the rectangular windows 33. As best seen in FIG. 8, each beam connection port 10 includes four vertical slots 34 and a horizontal slot 35. In addition, a pair of upper slots 28 (FIG. 10) are located directly above the beam connection ports 10 for connecting an upper utility trough of a shorter panel frame 2 at a change of height location. A small window 36 (FIG. 9) of the beam connection port 10 includes a downwardly extending tab 37 having a wedge-engaging surface 15 along the lower edge thereof. In addition, the front faces 27 of each post 6 include apertures 38 for mounting of the cover panels 4. Each of the posts 6 have a single, vertically adjustable foot 39 which is received in a threaded plate 40 that is welded to the lower end 8 of the post. The front face 27 also include four apertures 41 near the lower end 8 of each post for removably mounting a base cover 42. Each post 6 is made from a larger U-shaped piece 43 and a smaller U-shaped piece 44, each of which is formed from sheet metal. The larger and smaller U-shaped pieces 43 and 44 are welded together at the edge 45.

With reference to FIGS. 2–6, each beam 11 has a movable lock wedge 12 that is rotatably mounted to the upper side 47 of the beam 11 by a rivet 46. The beam 11 includes four tabs and slots that form downwardly extending hooks 48 at each end that are received in vertical slots 34 of the beam connection port 10. Each hook 48 forms a slot 50 that engages the bottom edge 49 of each vertical slot 34. The lock wedge 12 is formed from sheet metal, and includes a flat body portion 53 that forms a lever arm for mechanical advantage whereby the lock wedges 12 can be manually shifted from a retracted unlocked position to an extended locked position by a person without the use of tools. An upwardly turned flange 51 provides a surface for an installer to push against for manually rotating the locking wedge 12 out of the engaged position in a direction opposite the arrow "A" shown in FIGS. 4 and 5. Each locking wedge 12 also includes a downward flange 52 that provides a stop when the locking wedge 12 is rotated into the extended locked position shown in FIG. 5. Shifting the locking wedge 12 to the extended locked position inelastically deforms the wedge-engaging surface 15 of the downwardly extending tab 37 due to the tight interference fit between the extension 54 of the locking wedge 12 and the wedge-engaging surface 15. The extension 54 is "coined," or flattened at 121 to facilitate engagement with the wedge engaging surface 15. In the illustrated example the wedge-engaging surface 15 is permanently or inelastically deformed; however, a tight interference fit that does not result in inelastic deformation may also be used to lock the beam 11 to the post 6. Alternatively, the locking wedge 12 could have a tapered cam surface on the extension 54 to progressively engage the wedge-engaging surface 15 to form a tight interference fit. This interference fit may be chosen such that the wedge-engaging surface 15 is inelastically deformed in a similar manner to that shown in FIGS. 5 and 6.

Figure 15:
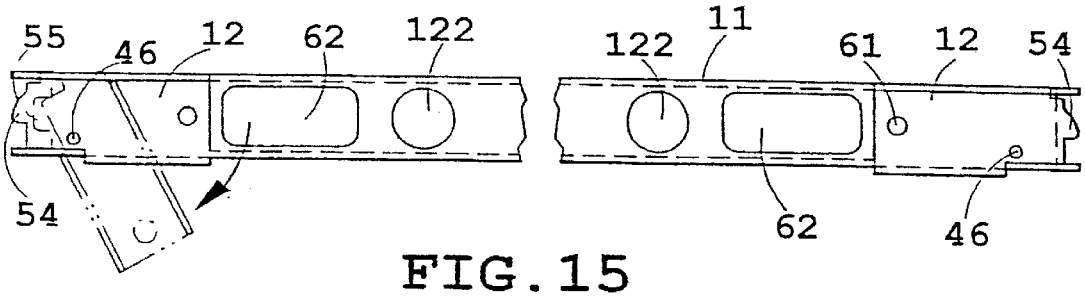
FIG. 15 is fragmentary, top plan view of the beam.
Figure 14:
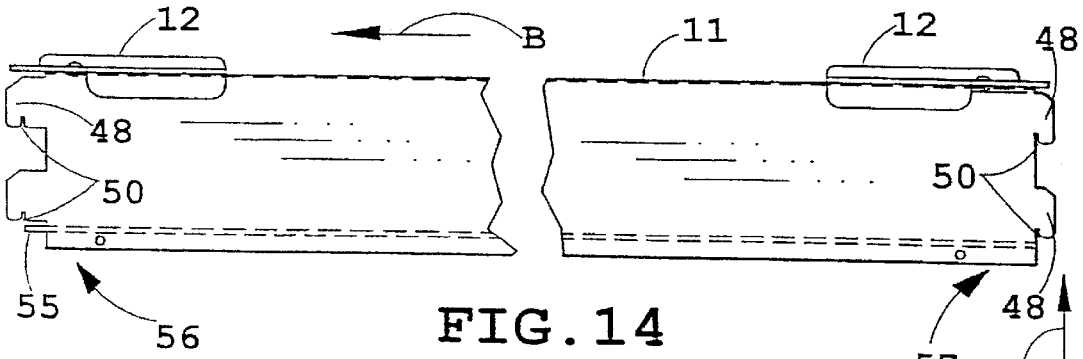
FIG. 14 is a fragmentary, side elevational view of the beam.
Figure 16:
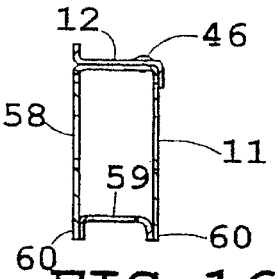
FIG. 16 is a side elevational view of the beam.

Each beam 11 is designed to be removed from between a pair of posts 6 that form assembled panel frames 2 adjacent the panel frame being disassembled in a manner similar to the data trough 25 illustrated in FIG. 3. This is accomplished by providing longer, extended hooks 48 at a first end 56 of the beam 11 (FIG. 14). In addition, a horizontal tab 55 is provided at the first end 56 (FIGS. 14–16). The beam 11 is removed by shifting it in the direction of the arrow "B" (FIG. 14) and then raising the second end 57 in the direction of the arrow "C" and then sliding the beam 11 in a direction opposite the arrow B. The horizontal tab 55 provides stability and guides the first end 56 of the beam 11 when shifted in a direction indicated by the arrow B, but does not engage the horizontal slot 35 when the beam is shifted downward into the vertical slots 34. Each beam 11 is made from an upper U-shaped piece 58 and a lower U-shaped piece 59 which are welded together adjacent the edge 60 (FIG. 16). In addition, each beam 11 may include rectangular windows 62 and circular windows 122 through the beam 11 for vertical routing of data or power lines 23, 24 through the beams 11 within the panel frame 2. Each locking wedge 12 includes an aperture 61 which is used to hang the locking wedge 12 for painting during the fabrication process.

Figure 18:
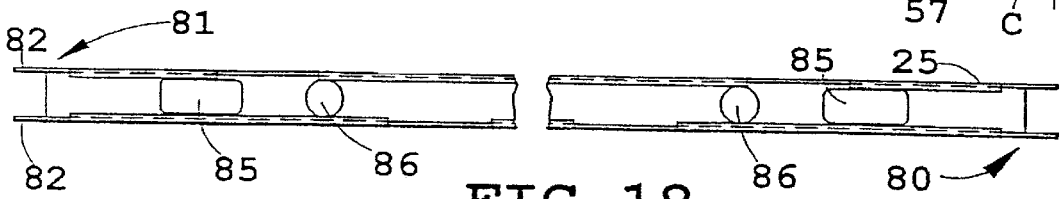
FIG. 18 is a fragmentary, top plan view of the data trough.
Figure 17:
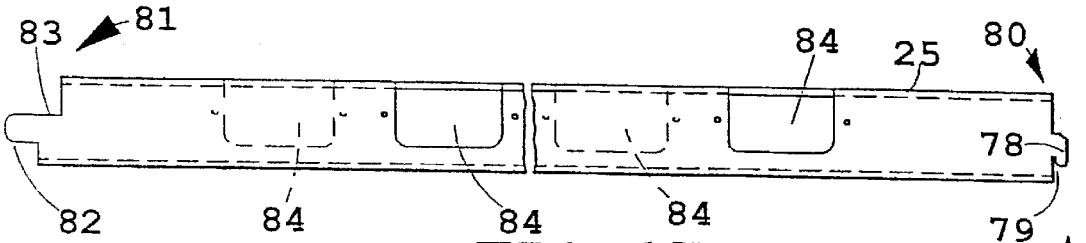
FIG. 17 is a fragmentary, front elevational view of the data trough.
Figure 19:
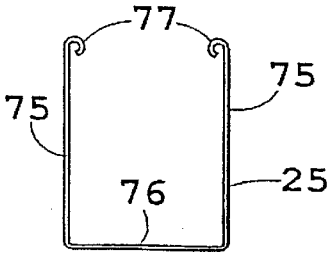
FIG. 19 is a side elevational view of the data trough.
Figure 21:
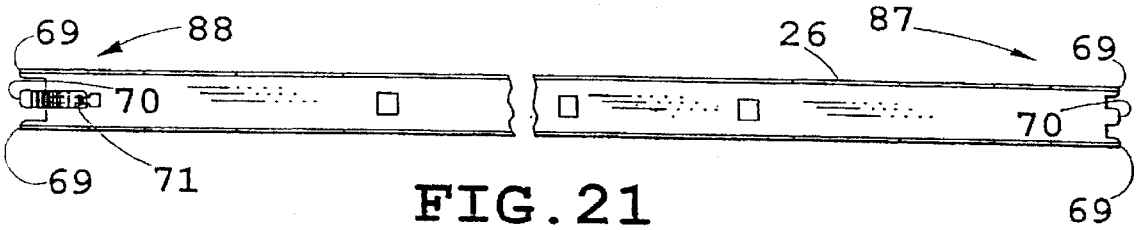
FIG. 21 is a fragmentary, top plan view of the power trough.
Figure 20:
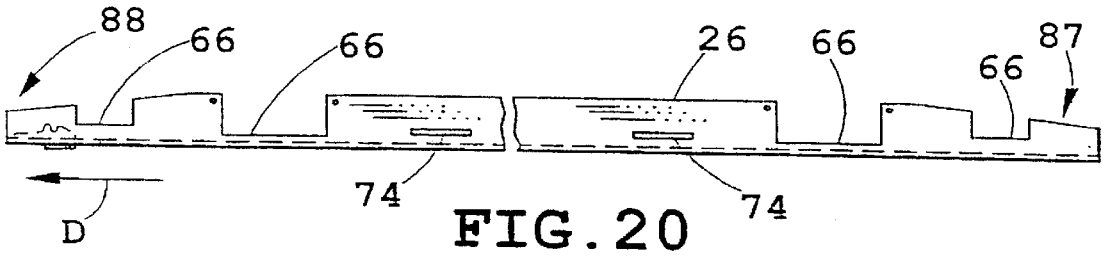
FIG. 20 is a fragmentary, front elevational view of the power trough.
Figure 22:
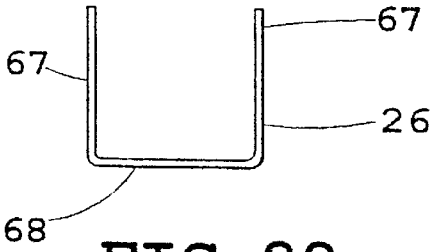
FIG. 22 is a side elevational view of the power trough.

Two types of utility troughs may be utilized for routing of data and power lines 23, 24. A data trough 25 is illustrated in FIGS. 17–19, and a power trough 26 is illustrated in FIGS. 20–22. Either trough may be used for routing of data or power lines 23, 24 within the trough; however, only the power trough 26 is utilized for hanging power boxes 63 and power lines 24 therebelow.

With reference to FIGS. 17–19, each data trough 25 has a U-shaped cross-sectional shape that includes a bottom wall 76 and side walls 75 having a curved-under top edge 77. Each data trough 25 also includes a pair of tabs 78 and a slot 79 forming a downwardly extending hook at a first end 80. At a second end 81, the data trough 25 includes a pair of tabs 82 with a cut-back portion 83 that provides clearance when the first end 80 of the data trough is tipped upward in a direction of the arrow "E" (FIG. 17) during removal and installation of the data trough 25 between a pair of posts 6 when the panel frame 2 is in an assembled condition (FIG. 3). Each of the data troughs 25 includes cut-out portions 84 for mounting of data receptacles 65, and rectangular apertures 85 and circular apertures 86 for vertical routing of data and power lines 23, 24 within the panel frame 2.

With reference to FIGS. 20–22, each power trough 26 has a generally U-shaped cross-sectional shape, and includes cut-out portions 66 along the side walls 67 for mounting data receptacles 65 (FIG. 3). Each end of the power trough 26 includes two L-shaped tabs 69 and a horizontal tab 70 (FIG. 8) which are received in the L-shaped slots 72 and the horizontal slot 73, respectively, of a utility trough port 21 (FIG. 4). One end of the power trough 26 includes a locking wedge such as sliding wedge 71 that is moved in the direction of the arrow "D" of FIG. 20 after the power trough 26 is positioned in the utility trough port 21, thereby providing a tight interference fit which prevents movement of the utility trough 26 when an electrical line is plugged into the power receptacle 64. Alternatively, a locking wedge 12 could also be utilized for attachment of the power trough 26 to the post 6. Elongated slots 74 provide a snap-in mounting for power boxes 63 as illustrated in FIG. 3.

Figure 26:
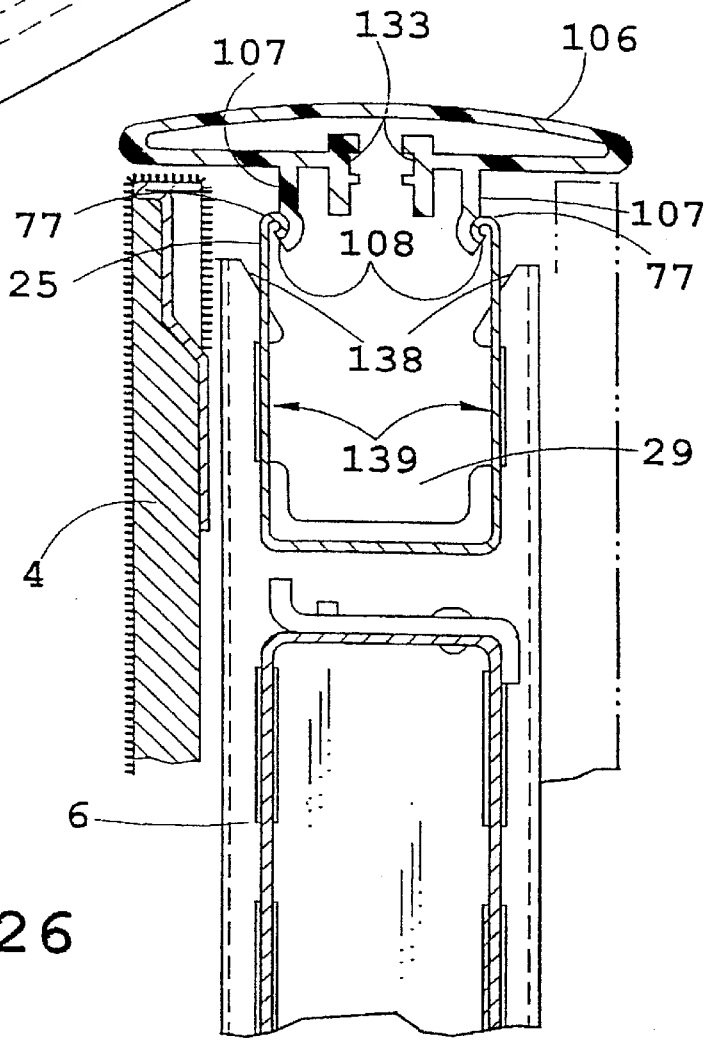
FIG. 26 is a fragmentary, side elevational view of the assembled knock-down portable partition showing the top cap installed into the data trough.

As best seen in FIGS. 3–17 and 18 the data trough 25 may be installed by inserting the second end 81 into the utility trough port of a post 6. The first end 80 is rotated downward, the beam is then shifted in the direction of the first end 80 and down, opposite the arrow E (FIG. 17) to engage the slots 79 into the L-shaped slots 72 of the utility trough port 21. With reference to FIG. 26, each of the upper utility ports 29 include tapered upper edges 138 and vertical notch portions 139. During installation of the upper data troughs 25, the tabs 78 and 82 are pushed downward along the tapered edges 138 and snap into the vertical notch portions 139. The power troughs 26 may be installed in a similar manner by inserting the L-shaped tabs 69 and horizontal tab 70 into the corresponding L-shaped slots 72 and horizontal slot 73 of a utility trough port 21 (FIG. 8). The second end 88 (See FIG. 20) is then rotated downward and the utility trough is shifted in the direction of the second end 88 to engage the L-shaped tabs 69 and the horizontal tab 70 into the corresponding L-shaped slots 72 and horizontal slot 73 of a utility trough port 21. The sliding wedge 71 is then shifted in the direction indicated by the arrow D shown in FIG. 20.

Figure 23:
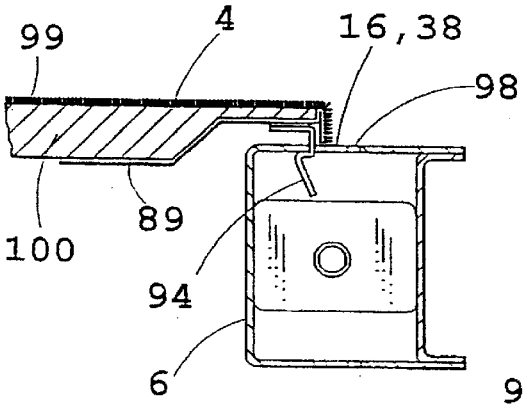
FIG. 23 is a fragmentary, top plan view of a vertical post showing the cover panel engaging the cover mounting apertures.
Figure 24:
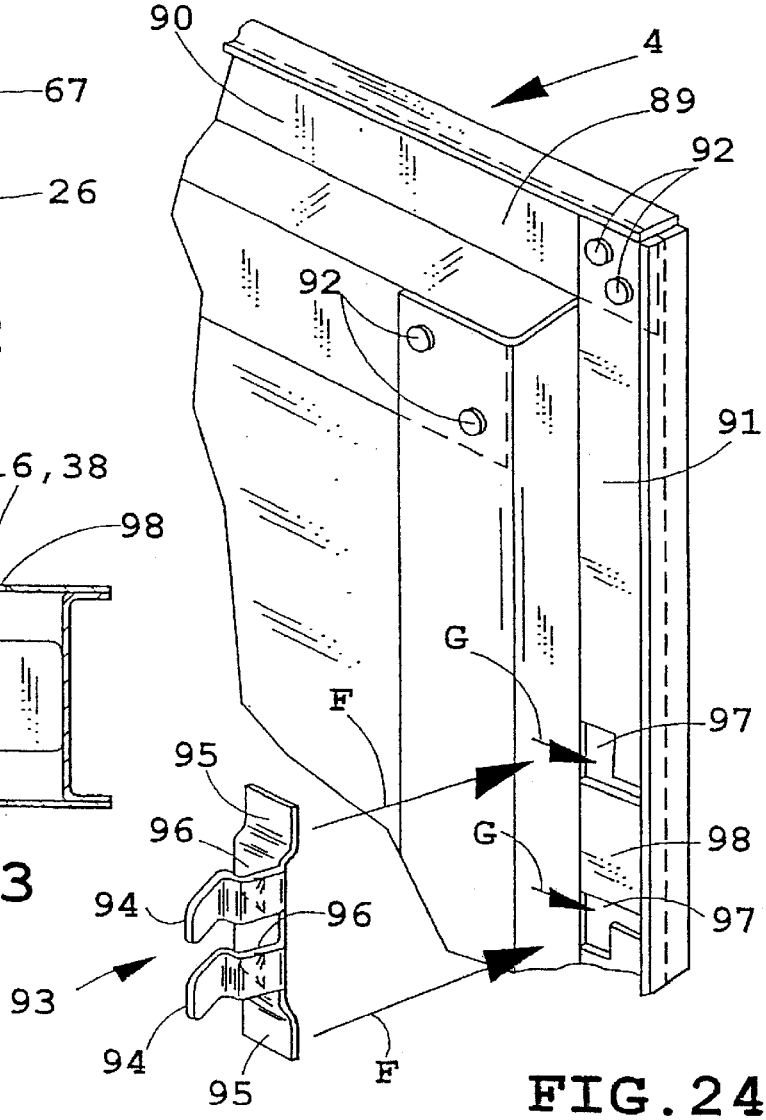
FIG. 24 is a fragmentary, perspective view of the cover panel showing the mounting of the cover retaining clips.

With reference to FIGS. 23 and 24, each cover panel 4 includes a cover frame 89 that includes horizontal members 90 and vertical members 91 that are "toggle locked" together at 92. Clips 93 include tabs 95 and spurs or bent-out portions 96, and arms 94. The clips 93 are installed to the cover frame 89 by inserting the tabs 95 into apertures 97 in the direction indicated by the arrows "F" shown in FIG. 24. The clip 93 is then slid in the direction of the arrows "G." This causes the spurs or bent-out portions 96 to engage the surface 98 between the apertures 97, thereby preventing the clip from shifting in a direction opposite the arrow G. With reference to FIGS. 4 and 23, the arms 94 of each clip 93 are received into the outer portion 98 of the apertures 38 in the vertical post 6. The apertures 38 position adjacent covers 4 in a spaced-apart relationship to provide clearance for the vertical row of slots 16. In addition, the apertures 38 provide support for the cover 4 so that the cover is held securely in position and does not shift vertically. Each cover 4 includes an outer decorative fabric layer 99 and a thicker acoustic layer 100 which may be made from a fiberglass mat or other suitable material.

Figure 25:
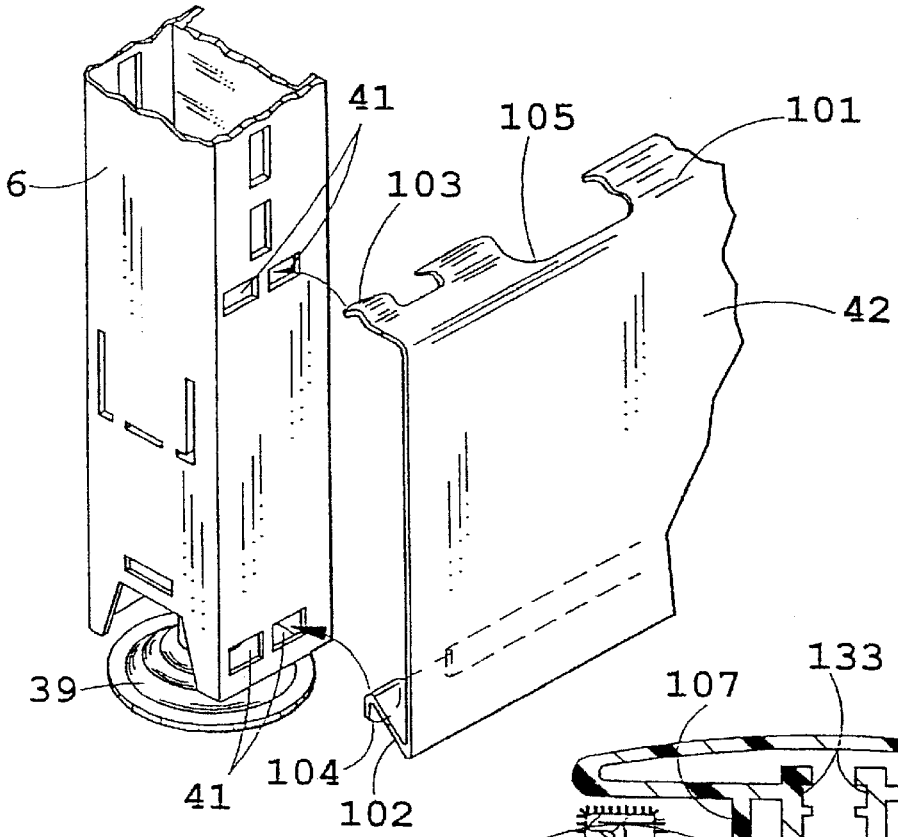
FIG. 25 is a fragmentary, perspective view showing the base cover and mounting tabs.

With reference to FIG. 25, each base cover 42 is formed from sheet metal and includes an upper flange 101 and a lower flange 102. An upper tab 103 at each end of the upper flange 101 snaps into engagement with an aperture 41, and a lower tab 104 engages an aperture 41 to retain the base cover 42 to the post 6. A cut-out 105 along the upper flange 101 provides clearance for vertical routing of data or power lines 23, 24.

With reference to FIG. 26, a top cap 106 which is molded from a polymeric material includes a pair of downwardly extending legs 107 with arcuate portions 108 which snap into the curved-under top edge 77 of a data trough 26.

Figure 27:
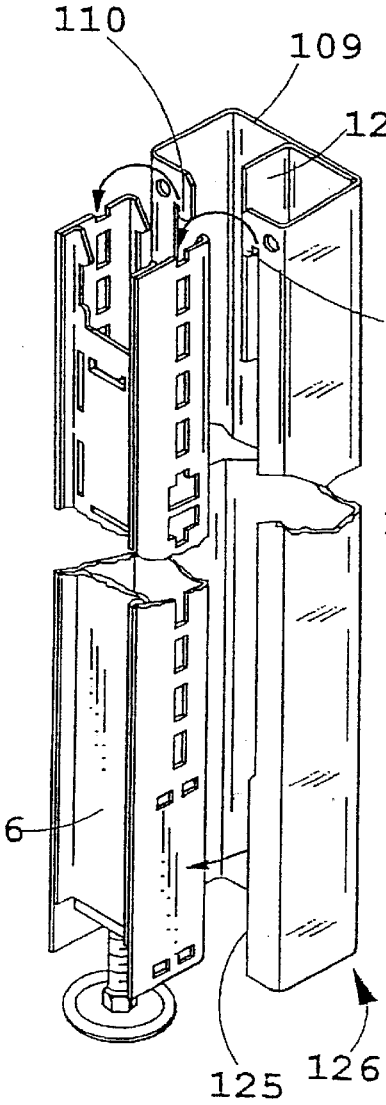
FIG. 27 is a fragmentary, perspective view showing an end cover and vertical, end-of-run post.
Figure 31A:
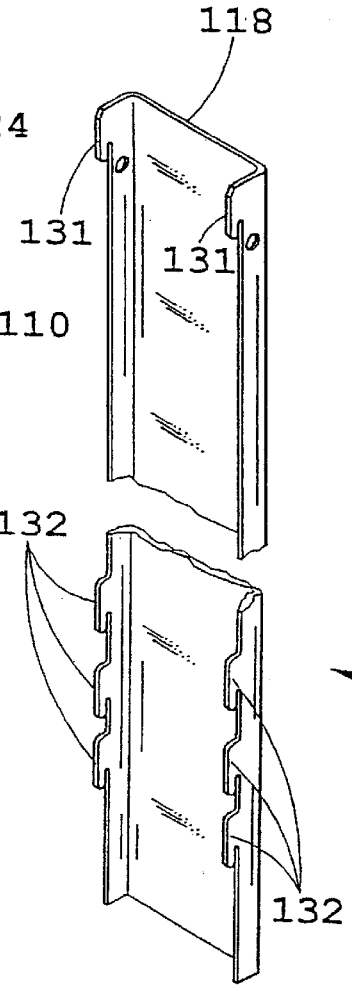
FIG. 31A is a fragmentary, perspective view of a T-cover.
Figure 28:
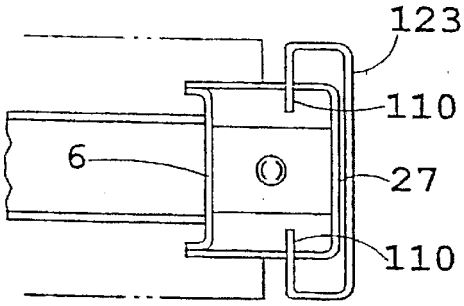
FIG. 28 is a fragmentary, top plan view of an end-of-run post with an end cover installed.
Figure 28A:
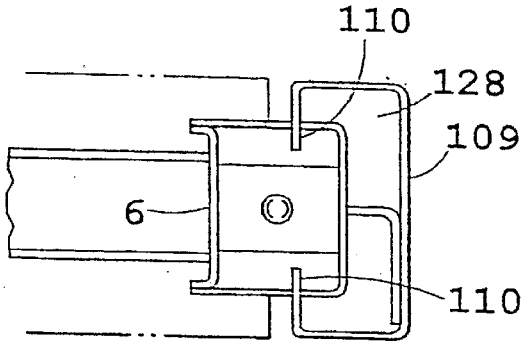
FIG. 28A is a fragmentary, top plan view of an end-of-run post with a change-of-height end cover installed.

With reference to FIGS. 27, 28 and 28A, a change-of-height end cover 109 includes slotted tabs 110 which engage the uppermost slots in a vertical row of slots 16 (FIG. 11) to provide a decorative cover for the post 6. After the slotted tabs 110 are engaged, the lower end 126 of the end cover 109 is slid over the lower end 8 of the post 6 to frictionally engage the narrow portions 125 against the post 6. The end cover 109 includes a brace 124 that offsets the end cover 109 to provide a vertical passage 128 for data and power lines 23 and 24. The end-of-run cover 123 is similar to the change-of-height end cover 109, except that the end-of-run cover 123 rests against the post 6 at the inner surface 127.

Figure 30A:
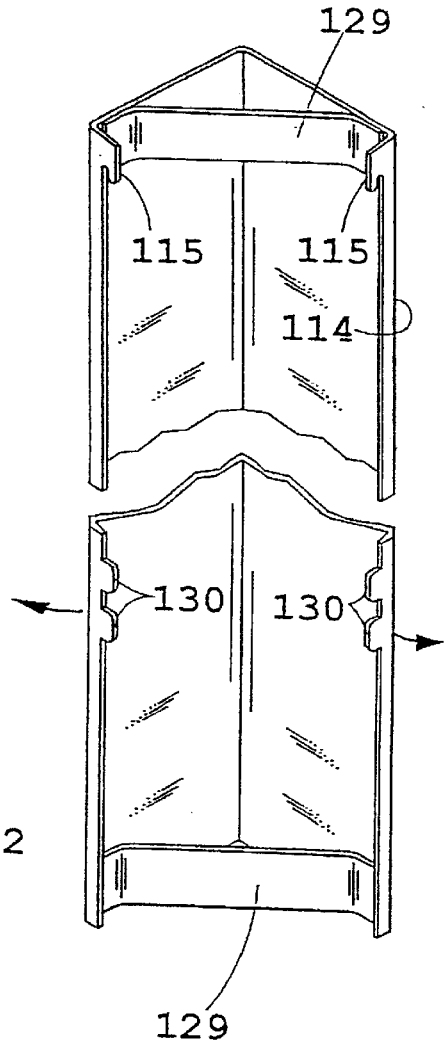
FIG. 30A is a fragmentary, perspective view of an L-cover.
Figure 29:
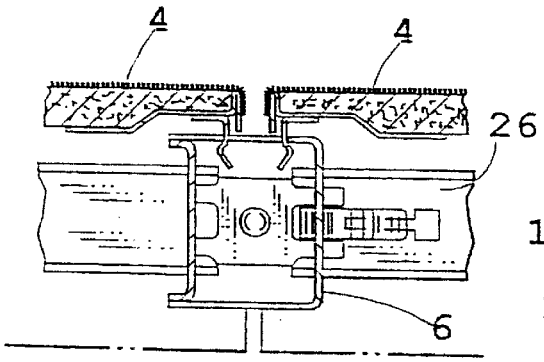
FIG. 29 is a vertical intermediate post with cover panels installed into a front face, and power troughs installed on the opposite side faces.
Figure 30:
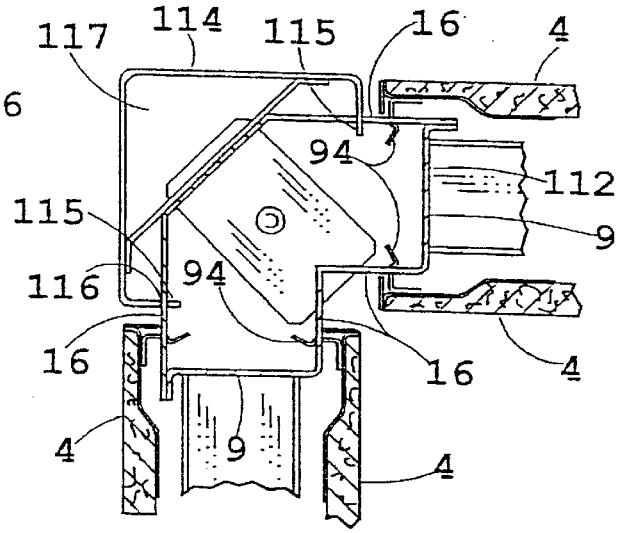
FIG. 30 is a fragmentary, top plan view of an L-post and cover.
Figure 31:
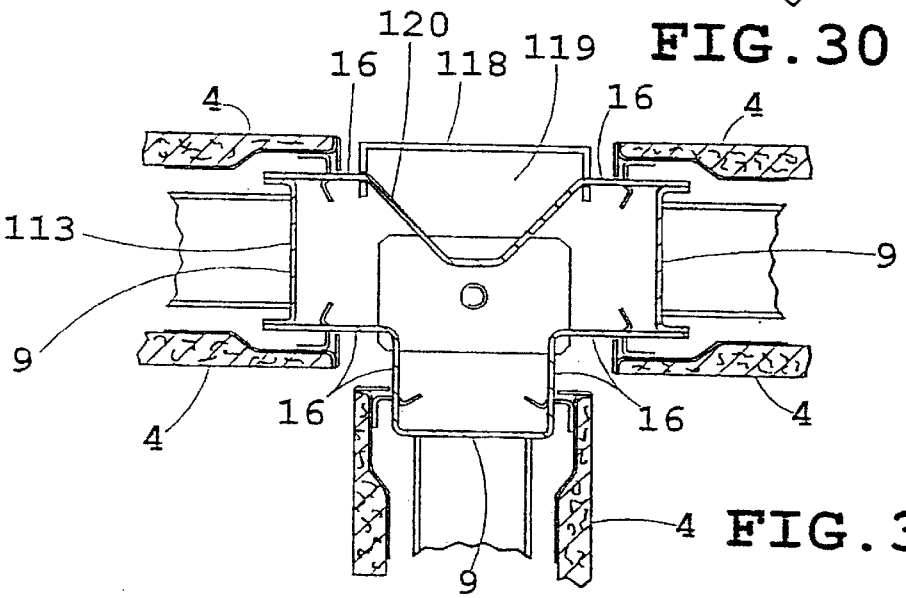
FIG. 31 is a fragmentary, top plan view of a T-post and cover.
Figure 27A:
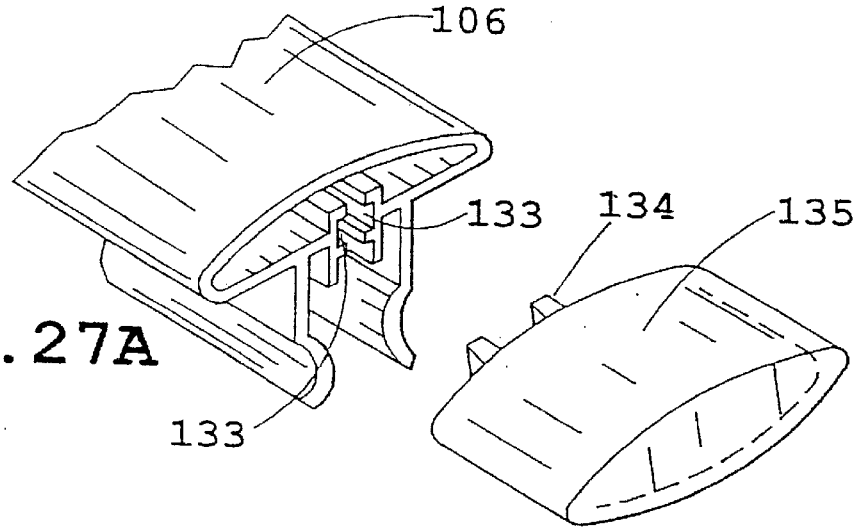
FIG. 27A is a fragmentary, perspective view of an end-of-run top cap and a top cap.
Figure 30B:
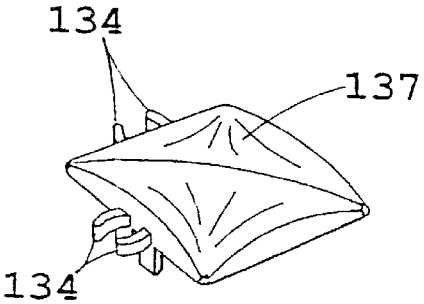
FIG. 30B is a perspective view of an L-top cap.
Figure 32:
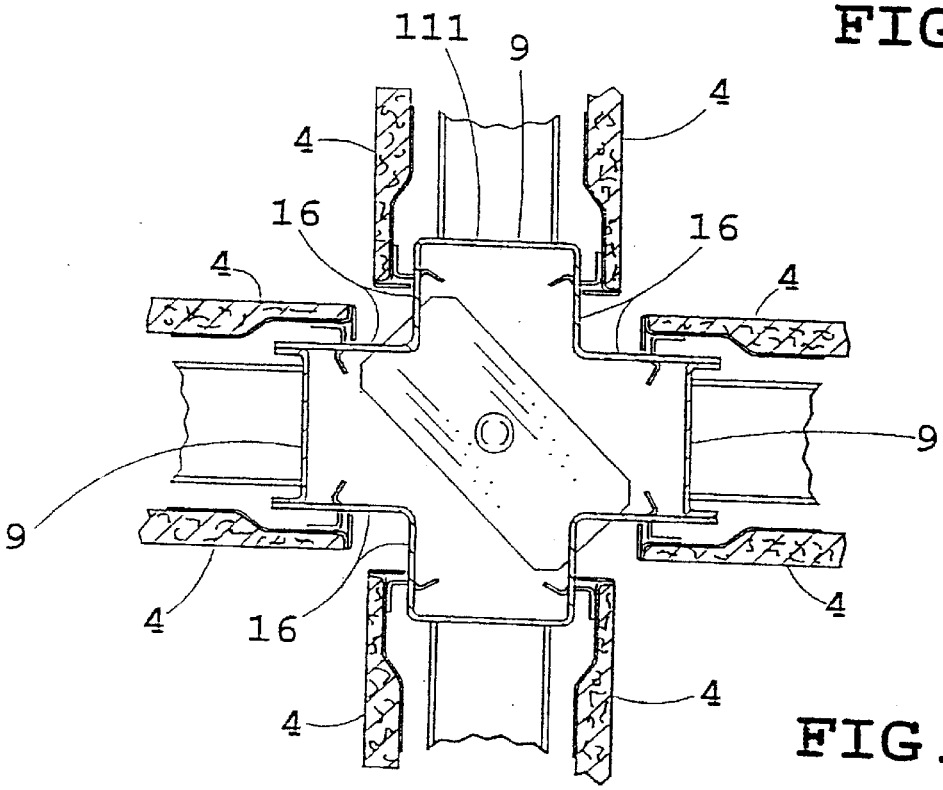
FIG. 32 is a fragmentary, top plan view of an X-post.

With reference to FIGS. 29–32, the partition system 1 may include an in-line or end-of-run post 6 (FIG. 29), an L-post 112 (FIG. 30), a T-post 113 (FIG. 31), and an X-post 111 (FIG. 32). The intermediate or end-of-run post 6 may be used at an end-of-run location with an end cover 109, or at an intermediate location as illustrated in FIG. 29. With reference to FIG. 27A, an end-of-run top cap 135 is made of a polymeric material, and includes integral clips 134 which are received into the notch areas 133 of the top cap 106. The change-of-height top cap (not shown) is similar to the end-of-run top cap 135, except that it is slightly longer as required to correspond to the greater width of the change-of-height end cover 109 (FIG. 28A). With reference to FIGS. 30 and 30A, each L-post may be covered by an L-cover 114 which includes hooks 115 for engaging slots 116 in the L-post 112. Each L-cover 114 also includes smaller tabs 130 (FIG. 30A) which engage the vertical row of slots 16 to retain the lower end thereof. A brace 129 provides a rigidity at the upper and lower ends of the L-cover 114. The L-cover 114 provides an open vertical passage 117 that may be utilized for vertical routing of electrical or power lines. With reference to FIG. 30B, an L-top cap is made of a polymeric material, and includes integral clips 134 that are received into the notch areas 133 of the top cap 106 (FIG. 26). The spacing of the covers 4 and the L-cover 114 provides clearance such that hang-on binder bins or other accessories may be hung from the vertical row of slots 16.

Figure 31B:
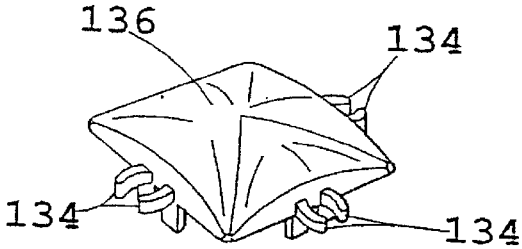
FIG. 31B is a perspective view of a T-top cap.

The T-post 113 includes a recessed portion 120, which, in combination with the T-cover 118 provides a vertical passage 119 for vertical wiring of power or communications cabling (FIG. 31). The T-cover 118 includes upper hooks 131 and lower hooks 132 that engage the vertical row of slots 16. With reference to FIG. 31B, a T-top cap 136 includes integrally formed clips 134 that are received in the notch areas 133 of the top cap 106.

With reference to FIG. 32, an X-post 111 has a generally X-shaped plan configuration for joining four panel frames 2 in an X formation. All of the post configurations have a single foot 39, and also have opposite faces with a plurality of beam connection ports 10 and utility trough ports 21 in the same configuration as the in-line post 6. In addition, each of the posts include a vertical row of slots 16 for support of hang-on accessory units.

Figure 33:
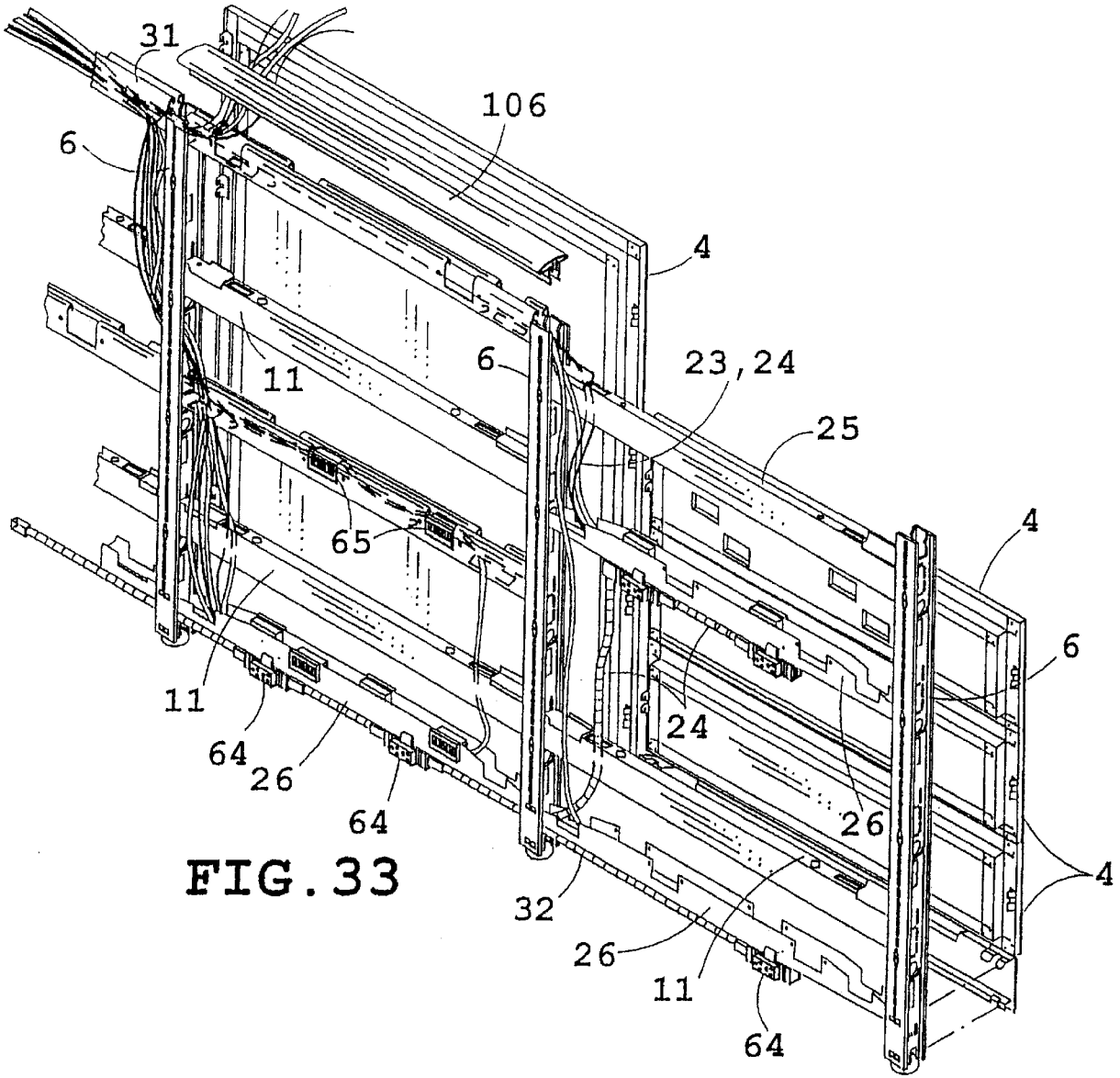
FIG. 33 is a fragmentary, exploded perspective view of the partition system showing the data and power lines and receptacles.
Figure 34:
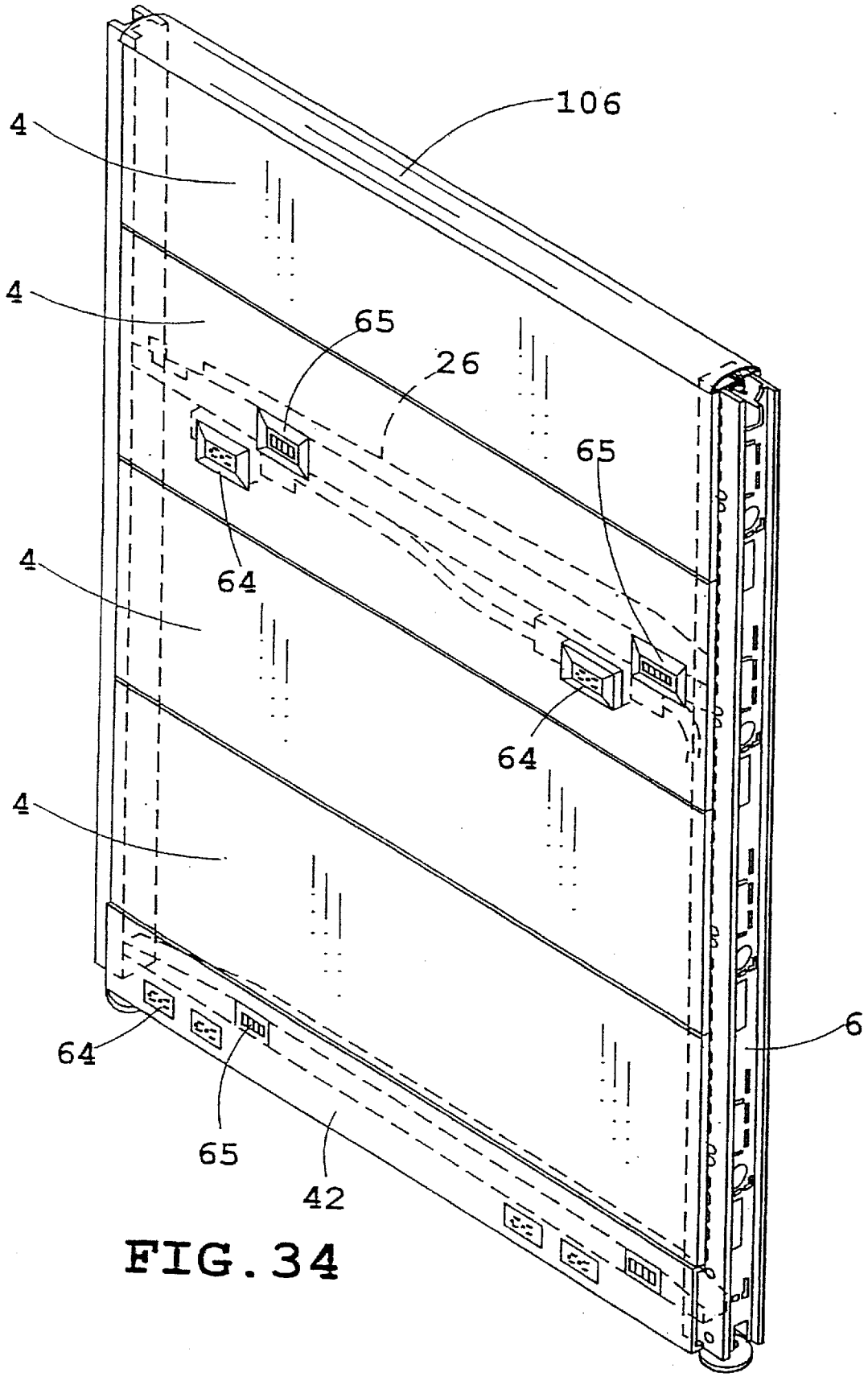
FIG. 34 is a perspective view of an individual panel section showing the data and power receptacles at the base and beltway heights.

With reference to FIG. 33, the data and power troughs 25 and 26 provide a flexible, easily installed system for support of data and power lines 23 and 24, and the power and data receptacles 64, 65. The data and power lines 23, 24 may be ran vertically through the apertures in the utility troughs and beams. As illustrated in FIG. 34, a single power trough mounted at a beltway-high level may provide for both power receptacles 64 and data receptacles 65. The base covers 42 are also cut out to provide for both power and data receptacles 64, 65 at the base of the panel.

The knock-down portable partition system 1 of the present invention provides a flexible, easily shipped and assembled system having capability for handling a wide range of power and communications cabling needs. The panel frame 2 is simple, and quickly assembled yet provides sufficient structural strength for support of hang-on accessories such as binder bins 18, work surfaces 19, and lower file storage units 20. Each post utilizes a single foot for support, thereby simplifying the vertical adjustment of the panel frame 2. The beams 11 and the data and power troughs 25, 26 may all be removed from between a pair of vertical posts 6 while the adjacent panel frames 2 are in an assembled condition. The cover panels 4 are easily removed and installed and provide an acoustic, sound-absorbing layer.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. A knock-down portable partition, comprising:

a rigid panel frame having a central portion;

at least one cover panel covering at least a portion of the central portion of said rigid panel frame;

connectors detachably mounting said cover panel on said rigid panel frame to facilitate assembly and removal of said cover panel on said rigid panel frame;

said rigid panel frame including:

at least two vertical posts each having an upper end, a lower end and opposite side faces;

upper and lower beams extending generally horizontally between said vertical posts, and rigidly, yet releasably, interconnecting said posts in a manner permitting assembly and disassembly of said knock-down portable partition;

at least one utility trough extending between said posts for routing of utility lines within said partition, said utility trough having connectors thereon removably supporting said utility trough on said panel frame in a manner permitting removal from said panel frame without disassembly of said panel frame.

2. The partition as set forth in claim 1, wherein:

said posts include beam connection ports, each post having a window through said opposite side faces, and an aperture through said post transverse to said window; and pins extending through said aperture and an end portion of each said beam and rigidly interconnecting said posts and said beams.

3. The partition as set forth in claim 1, wherein:

said posts include beam connection ports, each having wedge engaging surfaces; and said beams each including locking wedge members movably mounted on opposite ends thereof, said lock members shiftable between a disengaged position permitting disassembly of said panel frame, and an engaged position wherein said locking wedge members engage said wedge engaging surfaces in a tight interference fit and rigidly interconnect said posts and said beams.

4. The partition as set forth in claim 1, wherein:

said posts each include a utility trough port; and said connectors on said utility troughs are configured to permit horizontal shifting of said utility trough to engage and disengage said connectors with said utility trough ports.

5. The partition as set forth in claim 1, wherein:

said connectors are positioned adjacent opposite ends of said utility trough and engage said posts to support said utility troughs.

6. The partition as set forth in claim 5, wherein:

said utility trough ports include at least one aperture defining a lower edge;

a first one of said connectors includes a tab slidably received within a selected aperture; and a second one of said connectors includes a hook received within an aperture to secure said utility trough and prevent horizontal shifting thereof when said hook engages said lower edge of said aperture.

7. The partition as set forth in claim 1, wherein:

said posts each include a downwardly-opening cut-out at a lower end thereof to permit unimpeded routing of utility lines along a lower edge of said panel frame.

8. The partition set forth in claim 1, wherein:

said upper and lower beams define opposite ends having threadless quick-connectors thereon rigidly yet releasably interconnecting said posts adjacent said connection ports.

9. The partition set forth in claim 1, wherein:

said utility troughs have an upwardly-opening U-shaped cross section.

10. A knock-down panel frame construction, comprising:

at least two vertical posts, each having opposite side faces;

upper and lower beams extending between and rigidly yet releasably interconnecting said vertical posts; and at least one utility trough extending between said posts for routing of utility lines, said utility trough having connectors on opposite ends thereof removably supporting said utility trough on said panel frame in a manner permitting removal from said panel frame without disassembly of said panel frame.

11. The knock-down panel frame set forth in claim 10, wherein:

said posts include beam connection ports, each having a window through said opposite side faces, and an aperture through said post transverse to said window; and pins extending through said aperture and an end portion of each said beam and rigidly interconnecting said posts and said beams.

12. The knock-down panel frame set forth in claim 10, wherein:

said beams include beam connection ports, each having lock engaging surfaces; and said beams each including lock members movably mounted on opposite ends thereof, said lock members shiftable between a disengaged position permitting disassembly of said panel frame, and an engaged position wherein said lock members engage said lock engaging surfaces in a tight fit and rigidly interconnect said posts and said beams.

13. The knock-down pane frame set forth in claim 10, wherein:

said posts each include a utility trough port; and said connectors on said utility troughs are configured to permit horizontal shifting of said utility trough to engage and disengage said connectors with said utility trough ports.

14. The knock-down panel frame set forth in claim 10, wherein:

said connectors are positioned adjacent opposite ends of said utility trough and engage said posts to support said utility troughs.

15. The knock-down panel frame set forth in claim 14, wherein:

said utility trough ports include at least one aperture defining a lower edge;

a first one of said connectors includes a tab slidably received within a selected aperture; and a second one of said connectors includes a hook received within an aperture to secure said utility trough and prevent horizontal shifting thereof when said hook engages said lower edge of said aperture.

16. The knockdown panel frame set forth in claim 10, wherein:

said posts each include a downwardly-opening cut-out at a lower end thereof to permit unimpeded routing of utility lines along a lower edge of said panel frame.

17. The knock-down panel frame set forth in claim 10, wherein:

said upper and lower beams define opposite ends having threadless quick-connectors thereon rigidly yet releasably interconnecting said posts adjacent said connection ports.

18. The partition set forth in claim 10, wherein:

said utility troughs have an upwardly-opening U-shaped cross section.

19. A knockdown portable partition, comprising:

a rigid panel frame having vertically extending side faces and a central portion;

at least one cover panel extending over a selected side face and covering at least one portion of the central portion of said rigid panel frame;

connectors detachably mounting said cover panel on said rigid panel frame to facilitate assembly and removal of said cover panel on said rigid panel frame;

said rigid panel frame including:

at least two vertical posts each having an upper end, a lower end and opposite side faces extending transversely of said side faces of said rigid panel frame;

upper and lower beams extending generally horizontally between said vertical posts and rigidly yet releasably, connected to said opposite side faces of said posts in a manner permitting assembly and disassembly of said knock-down portable partition;

at least one utility trough extending between said posts for routing of utility lines within said partition, said utility trough having connectors thereon removably supporting said utility trough on said panel frame.

20. The partition as set forth in claim 19, wherein:

said posts include beam connection ports, each post having a window through said opposite side faces, and an aperture through said post transverse to said window; and pins extending through said aperture and an end portion of each said beam and rigidly interconnecting said posts and said beams.

21. The partition as set forth in claim 19, wherein:

said posts include beam connection ports, each having lock engaging surfaces; and said beams each include lock members movably mounted on opposite ends thereof, said lock members shiftable between a disengaged position permitting disassembly of said panel frame, and an engaged position wherein said lock members engage said lock engaging surfaces in a tight fit and rigidly interconnect said posts and said beams.

22. The partition as set forth in claim 19, wherein:

said posts each include a utility trough port; and said connectors on said utility troughs are configured to permit horizontal shifting of said utility trough to engage and disengage said connectors with said utility trough ports.

23. The partition as set forth in claim 19, wherein:

said connectors are positioned adjacent opposite ends of said utility trough and engage said posts to support said utility troughs.

24. The partition as set forth in claim 23, wherein:

said utility trough ports include at least one aperture defining a lower edge;

a first one of said connectors includes a tab slidably received within a selected aperture; and a second one of said connectors includes a hook received within an aperture to secure said utility trough and prevent horizontal shifting thereof when said hook engages said lower edge of said aperture.

25. The partition as set forth in claim 19, wherein:

said posts each include a downwardly-opening cut-out at a lower end thereof to permit unimpeded routing of utility lines along a lower edge of said panel frame.

26. The partition as set forth in claim 19, wherein:

said upper and lower beams define opposite ends having threadless quick-connectors thereon rigidly yet releasably interconnecting said posts adjacent said connection ports.

27. The partition as set forth in claim 19, wherein:

said utility troughs have an upwardly-opening U-shaped cross section.

* * * * *